United States Patent [19]

Payne et al.

[11] 4,138,033

[45] Feb. 6, 1979

[54] LIQUID CONTAINER LID

[76] Inventors: Larry E. Payne, 3224 Wesley Chapel Rd.; Kenneth D. Lancaster, Jr., 965-C Clubhouse Cir., W., both of Decatur, Ga. 30034

[21] Appl. No.: 869,520

[22] Filed: Jan. 16, 1978

[51] Int. Cl.[2] ..... A47G 19/22

[52] U.S. Cl. ..... 220/254; 220/90.4; 220/339

[58] Field of Search ..... 220/339, 337, 90.2, 220/90.4, 90.6, 268, 254, 1 T, 904, 254; 229/7 R, 7 S; 215/309, 311

[56] References Cited

U.S. PATENT DOCUMENTS

| | | | |
|---|---|---|---|
| 2,003,657 | 6/1935 | Stabblefield | 215/309 |
| 2,646,670 | 7/1953 | Spalding et al. | 215/311 |
| 2,921,707 | 1/1960 | Sloan | 215/228 |
| 3,015,411 | 1/1962 | Smith | 220/90.4 |
| 3,749,274 | 7/1973 | Mele et al. | 220/1 T |
| 3,779,417 | 12/1973 | Klein | 220/268 |
| 3,854,618 | 12/1974 | Beshnini | 215/311 |
| 3,871,550 | 3/1975 | Chiappe | 220/339 |
| 3,927,794 | 12/1975 | Erdman | 220/268 |

*Primary Examiner*—William Price
*Assistant Examiner*—Allan N. Shoap
*Attorney, Agent, or Firm*—Newton, Hopkins & Ormsby

[57] ABSTRACT

A lid for a beverage container comprising a first portion having an opening therethrough and a second portion integrally connected to the first portion and capable of being folded underneath the first portion to be normally biased to a sealing engagement with the aperture when the lid is fastened onto the rim of the container. When the user depresses the second portion, liquid is allowed to pass from the container.

5 Claims, 4 Drawing Figures

LIQUID CONTAINER LID

BACKGROUND OF THE INVENTION

1. Field of the Invention

This invention relates to liquid container lids, and more particularly, to lids which remain on the container while the user drinks therefrom through a depressible section on the lid.

2. Description of the Prior Art

It is known in the prior art to provide liquid container lids with an aperture therethrough that prevents spillage of the liquid and allows for drinking from the container without removing the lid. Frequently, straws are inserted through these apertures. Examples of such lids are disclosed in the following U.S. patents and French patent:

2,375,532 Di Cosme
2,646,670 Spalding et al
2,689,664 Vingron
2,861,716 Framer
2,974,815 Driscoll
3,301,459 Gardner
3,727,808 Fitzgerald
3,730,399 Dibrell et al
3,800,999 Serritella
3,927,794 Erdman
3,952,910 Wheeler
French Pat. No. 388719 Saignier These lids provide an effective seal against spillage before the aperture is first opened. However, when the aperture is created by punching out a scored portion, means for re-sealing the aperture is either not provided (Serritella and Erdman, for example) or is insufficient to provide a truly effective closure. For example, Vingron discloses a cover having a flap portion which may be torn along a score line, folded back for use to provide an opening and then refolded over the opening for storage. No provision is made for preventing leakage after refolding.

Garangiotis (U.S. Pat. No. 3,363,798) shows a resealable sliding closure for a pressurized beverage container.

SUMMARY OF THE INVENTION

The present invention comprises a non-spill cover for a liquid container comprising a first portion which has an outer peripheral section of the type which snap-fittingly engages the rim of the container to hold the cover thereon. An opening, defined along its perimeter by a raised groove, is provided through the top of the first portion within the boundaries of the rim section.

The second portion of the cover is integrally joined to the first portion along a fold-line adjacent the outer rim section and includes a groove on its surface which is shaped to conform with the groove in the first portion so that the grooves are in sealing registry when, in the operative position of the cover, the second portion is folded to underly the first portion. The second portion also includes a depression adjacent the fold line which is in mating engagement with a part of the rim section of the first portion when the second portion is folded about the fold line. A raised member is provided on the second portion which, when the second portion is in its operative position, extends above the surface of the first portion so as to engage the lips of the user. The cover also includes a snap fastener consisting of a ball on the second portion which engages the socket on the first portion when the cover is in the operative position.

In its operation, the second portion is folded downwardly along the fold line approximately 180° so that it underlies the first portion to normally close the opening. Slight pressure is applied to the ball on the second portion so that it engages the socket on the first portion. The cover is then secured along its peripheral section to the rim of a container to provide a substantially spill-proof lid. Access to the contents of the container can easily be provided by having the upper lip of the user engage the raised member on the second portion which causes the second portion to move away from its registry with the first portion to expose the opening, the second portion pivoting about the ball and socket fastener. As the container is tilted toward the user's mouth, the contents flow out of the opening into the user's mouth. When the user's lip disengages the raised member, the second portion pivots upwardly about the snap fastener and returns to its original sealing position.

It is, therefore, the primary object of the present invention to provide a liquid container lid which has a segmented portion which can be repeatedly moved between an open position to provide access to the contents of the container and a closed, sealing position to prevent spillage of the contents of the container.

Another object of the present invention is to provide a unitary lid for a liquid container which has a portion which is depressible to provide drinking access.

BRIEF DESCRIPTION OF THE FIGURES OF DRAWING

DETAILED DESCRIPTION OF THE EMBODIMENT

Figure 1:
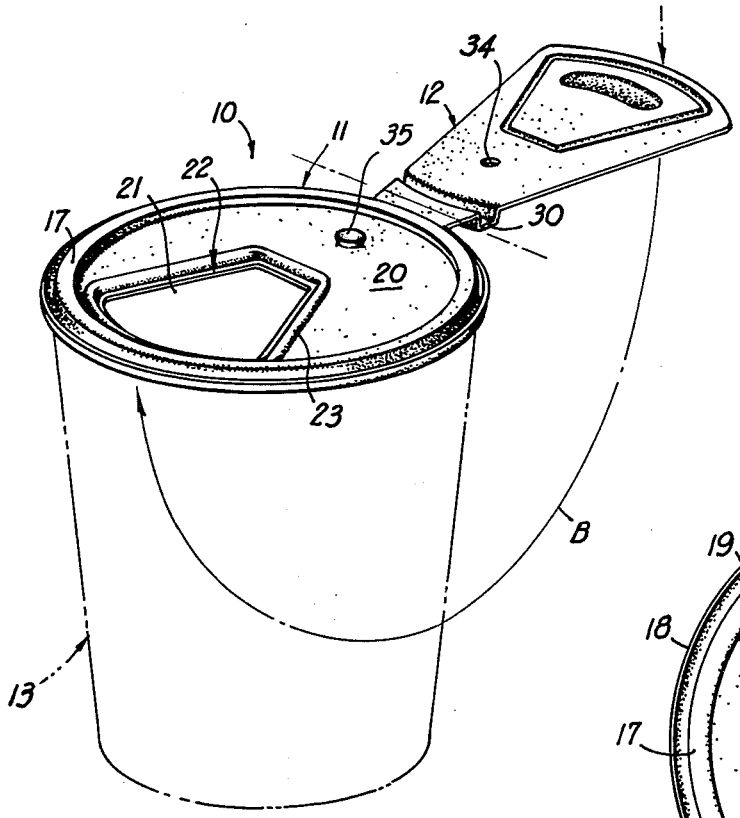
FIG. 1 is a perspective view of a lid according to the present invention with a liquid container shown in phantom lines.

The numeral 10 denotes generally the lid of the present invention and is comprised of a first portion 11 and a second portion 12. The lid 10 is used on a conventionally shaped liquid container shown in phantom lines as numeral 13 having a flat, annular bottom wall 14 with side walls 15 extending upwardly and outwardly from the periphery of bottom wall 14. The side wall 15 terminates at an upper end to define edge 16.

Figure 3:
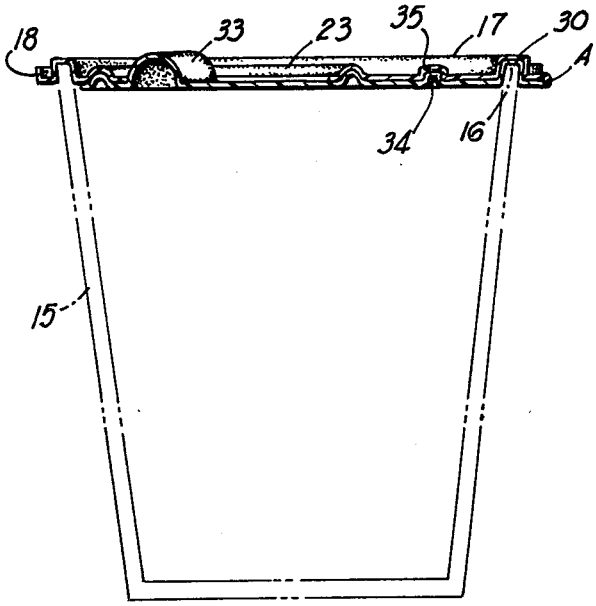
FIG. 3 is a side-elevational cross-section view of the lid and the container.
Figure 4:
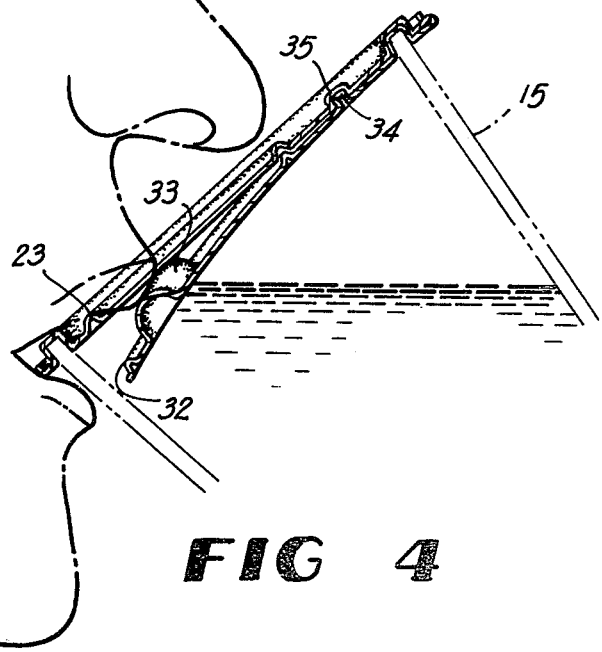
FIG. 4 is a view similar to FIG. 3 showing the invention in actual operation.

The first portion 11 has an annular peripheral section 17 which conforms in diameter to the lid 10 and provides a means for connecting the lid 10 to the container 13. The underside of rim section snap-fittingly engages the rim 16 as shown in FIGS. 3 and 4. An outer flange 18 is spaced about section 17 by means of annular connecting member 19.

Figure 2:
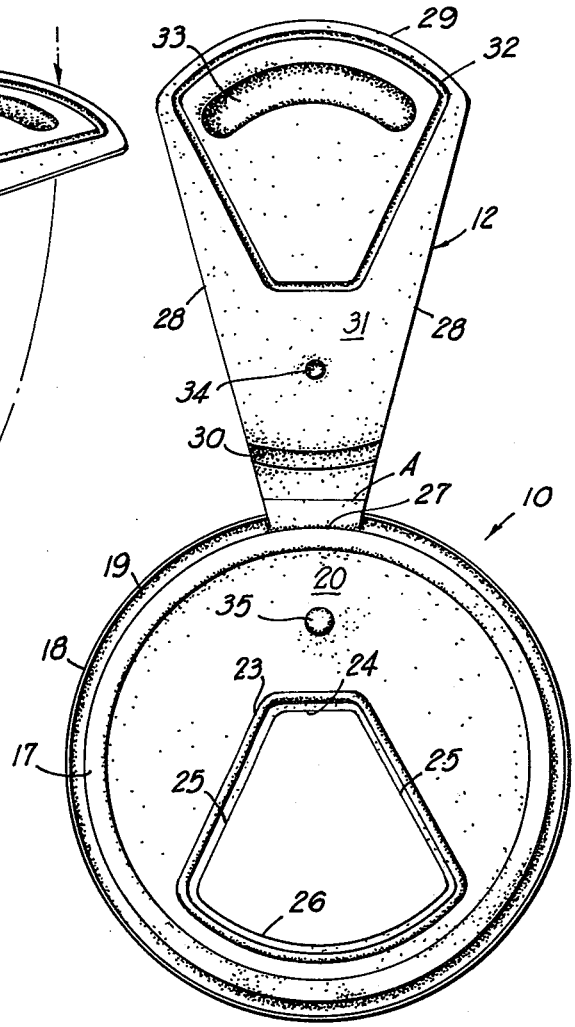
FIG. 2 is a top plan view of the lid of the present invention.

The inner section 20 of the first portion 11 within the confines of the section 17 is flat. An opening 21 defined by edge 22 is provided through inner section 20 and is bounded along edge 22 by means of groove 23 formed on the underside of inner section 20. The opening 21 and, thus, groove 23 can be of any desired configuration so as to provide access by the mouth of the user to the contents of container 13. As shown in FIG. 2, the edge 22 as viewed from above comprises a transverse top 24 with downwardly diverging sides 25 which are joined by arcuate bottom side 26.

As seen in FIG. 2, the second portion 12 generally has a configuration which is similar to edge 22 and is integrally connected to the first portion 11 along rear edge 27 adjacent rim section 17. Side edges 28 outwardly diverge from rear edge 27 and are joined by arcuate front edge 29. As second portion 12 extends outwardly from rear edge 27, it interrupts flange 18. A fold-line A transversely extends across second portion 12 adjacent the section 17. An arcuate depression 30 is formed in the flat bottom surface 31 of second portion 12 adjacent the fold-line A and is so dimensioned and located on second portion 12 as to be in mating engagement with the underside of rim section 17 when in the operative position, as described hereinbelow. A groove 32 is formed on bottom surface 31 and has the same configuration as groove 23 so that when the lid 10 is in its operative position on container 13, the grooves 23, 32 are in mating engagement as seen in FIG. 3. An arcuate shaped, raised member 33 is formed on second portion 12 within the confines of groove 32 and is dimensioned to extend above rim section 17 when the lid 10 is in the operative position as shown in FIG. 3.

The lid 10 includes a fastening means which is provided between the first and second portions and comprises a ball 34 formed on the second portion 12 which is in registry with the socket 35 formed in the inner section 20 of the first portion 11. It is understood, of course, that the location of the ball 34 and socket 35 could be reversed. The fastening means provides a point about which the second portion 12 pivots, as described hereinbelow.

In the operation of the present invention, the container 13 is filled with a suitable liquid. The second portion 12 is folded in the direction of B along fold-line A so that the depression 30 is in mating engagement with the underside of rim section 17 and grooves 23, 32 are in sealing engagement with each other. The ball 34 is pressed into engagement with socket 35. The lid 10 will then have the operative configuration as shown in FIG. 3.

The lid 10 is then releasably secured to the container 13 by having edge 16 engage the underside of rim section 17 and depression 30. The second section 12 will then be biased upwardly to a sealing engagement with the aperture 21 to provide a spill-proof cover for the container 13. Since second portion 12 is normally biased to a first or closed position over aperture 21, inversion of container 13 with lid 10 thereon causes the liquid therein to press against the bottom of second portion 12, further pressing groove 32 into sealing registration with groove 23 and prohibiting the liquid from escaping through aperture 21.

When the user desires to drink from container 13, he raises it to his mouth whereby his upper lip engages the raised member 33. Continued upward movement of the container 13 causes the upper lip to press gently downward on raised member 33, as shown in FIG. 4 to move second portion 12 about the engagement of the ball 34 and socket 35 and away from sealing engagement with aperture 21 to its second or open position. The liquid can now enter the mouth of the user, so long as the upper lip is pressing downwardly on raised member 33. The aperture 21 is of sufficient dimension to allow air to enter the container 13 to aid in the withdrawal of the liquid contents.

An alternative method of utilizing lid 10 would be for the user to press downward on member 33 with one of his fingers and then drink the contents through aperture 21.

When the user is through drinking from the container 13, removal of the upper lip from raised member 33 allows the second portion 12, because of its resiliency, to spring upwardly to its closed position. The user can repeatedly pivot second portion 12 in and out of sealing registration with aperture 21 until the contents of container 13 are consumed.

As seen the lid 10 is an improvement in the art since the depressible member is not glued or otherwise secured to the first portion of the lid 10.

What we claim is:

1. A lid for fastening onto the rim of a liquid container, comprising:

(a). a first portion having an outer periphery and means on said periphery for detachably connecting said lid to said rim, said first portion having an aperture therethrough; and (b) a second portion integrally connected to said periphery of said first portion by a hinge means, said hinge means including a fold-line, said second portion capable of being rotated about said fold line to underly and to be normally biased in mating and sealing engagement with said aperture when said lid is connected onto said rim, said second portion being elastically depressible to provide access to said container when force is applied thereto and returning to sealing engagement with said aperture when force is removed therefrom.

2. A lid as claimed in claim 1 wherein said aperture is defined by a groove formed in the underside of said first portion and wherein said second portion includes a groove which is dimensioned to be in mating engagement with said groove in said first portion when said second portion is in sealing engagement with said first portion.

3. A lid as claimed in claim 1 wherein said second portion has means for engaging the upper lip of a user, said engaging means including a raised member on said second portion so positioned that when said first and second portions are in sealing engagement, said raised member extends above said first portion through said aperture.

4. A lid as claimed in claim 1, including a means for fastening said first and second portions when said second portion underlies said first portion, said fastening means comprising a socket and a ball for mating engagement with said socket, said fastening means providing a point about which said second portion pivots when it is depressed.

5. A lid as claimed in claim 4 wherein said ball is on said second portion and said socket is on said first portion.

* * * * *